US008542131B2

(12) United States Patent
Jahn

(10) Patent No.: US 8,542,131 B2
(45) Date of Patent: Sep. 24, 2013

(54) MUSICAL KEY FOB VEHICLE LOCATOR

(76) Inventor: Deborah Michelle Jahn, Sparrow Bush, NY (US)

( * ) Notice: Subject to any disclaimer, the term of this patent is extended or adjusted under 35 U.S.C. 154(b) by 295 days.

(21) Appl. No.: 13/052,036

(22) Filed: Mar. 18, 2011

(65) Prior Publication Data

US 2012/0235835 A1 Sep. 20, 2012

(51) Int. Cl.
*G08G 1/123* (2006.01)

(52) U.S. Cl.
USPC ..... 340/989; 340/988; 340/937; 340/425.5; 340/426.13; 340/539.13; 340/539.26; 340/439; 701/485; 701/491

(58) Field of Classification Search
USPC ..... 340/989, 988, 937, 425.5, 426.13, 340/539.13, 539.26, 433; 701/485, 491
See application file for complete search history.

(56) References Cited

U.S. PATENT DOCUMENTS

| | | | | |
|---|---|---|---|---|
| 5,933,081 | A | 8/1999 | Jones | |
| 6,023,218 | A | 2/2000 | Tremblay | |
| 6,407,698 | B1 | 6/2002 | Ayed | |
| 6,489,897 | B2 | 12/2002 | Simon | |
| 6,694,258 | B2 | 2/2004 | Johnson et al. | |
| 6,791,477 | B2 | 9/2004 | Sari et al. | |
| 6,909,964 | B2 | 6/2005 | Armstrong et al. | |
| 7,145,507 | B2 | 12/2006 | Luo et al. | |
| 7,369,061 | B1 | 5/2008 | Sellers et al. | |
| 7,382,278 | B2 | 6/2008 | Buschman | |
| 7,385,526 | B1 | 6/2008 | Bullard et al. | |
| 7,394,362 | B2 | 7/2008 | Ogino et al. | |
| 7,564,342 | B2 * | 7/2009 | Klein | 340/425.5 |
| 7,847,709 | B2 * | 12/2010 | McCall et al. | 340/988 |
| 2002/0008614 | A1 | 1/2002 | Yeh et al. | |
| 2002/0067249 | A1 | 6/2002 | Johnson et al. | |
| 2003/0134600 | A1 | 7/2003 | Picone et al. | |
| 2004/0164861 | A1 | 8/2004 | Rawson | |
| 2004/0217848 | A1 * | 11/2004 | Cheng | 340/425.5 |
| 2006/0111835 | A1 | 5/2006 | Baker et al. | |
| 2009/0098907 | A1 * | 4/2009 | Huntzicker et al. | 455/556.1 |
| 2009/0264082 | A1 | 10/2009 | Tieman et al. | |
| 2010/0026503 | A1 * | 2/2010 | Proefke et al. | 340/601 |

FOREIGN PATENT DOCUMENTS

EP 0 350 554 A2 1/1990

OTHER PUBLICATIONS

Web pages from Finder Technologies dated Sep. 30, 2010. "Finder Technologies". http://www.findertechnologies.com/ Author Unknown. Two pages.

Web page from Amazon.com dated Sep. 30, 2010. "XO Vision DX370 Universal Car Alarm System . . .". http://www.amazon.com/XO-Vision-DX370-Universal-4-Button/. Author Unknown. One page.

Web page from Buyautotruckaccessories.com dated Sep. 30, 2010. "Wolo Music Time Horns". http://www.buyautotruckaccessories.com/ Author Unknown. One page.

Web page from GM Inside News dated Sep. 30, 2010. "Key fob morphs into high-tech wonder". http://www.gminsidenews.com/forums/f12/ Author Unknown. One page.

Web page from J.C. Whitney dated Apr. 21, 2011. "Wolo Antique-Style Ooogah Horn". http://wwwjcwhitney.com/antique-style-ooogah-horn/ Author Unknown. One page.

* cited by examiner

*Primary Examiner* — Tai T Nguyen
(74) *Attorney, Agent, or Firm* — Robert D. Gunderman, Jr.; Patent Technologies, LLC

(57) ABSTRACT

A musical key fob vehicle locator is disclosed that provides the ability to locate one's vehicle audibly. The musical key fob vehicle locator provides a radiofrequency linked controller to a vehicle and contains a digital audio file system to play music, a song, a riff or other recorded music composed and performed by musicians using actual musical instruments to facilitate the recording. This approach provides a pleasant, personalized, and uniquely recognizable audio locator that reflects the taste, personality, and likes of the vehicle owner.

18 Claims, 4 Drawing Sheets

MUSICAL KEY FOB VEHICLE LOCATOR

BACKGROUND OF THE INVENTION

1. Field of the Invention

This invention relates generally to locating devices, and more particularly to a key fob that uses music to locate a parked vehicle.

2. Description of the Related Art

The number of automobiles and related vehicles in use continues to grow. One result of this growth, particularly in urban areas, is the presence of large parking lots and parking garages. These large parking areas are commonly found around malls, sporting arenas, airports, and the like. With hundreds of cars in a given parking lot, many of them with a similar profile and color, it is easy for one to forget where they have parked, particularly after being away from their vehicle for several hours while shopping in a mall, watching a sporting event, or engaged in a similar distraction. A common approach to this problem is to walk up and is down aisles in a parking area in the hope of locating one's vehicle. This approach is time consuming, and oftentimes large vehicles such as vans, sport utility vehicles, and trucks block visibility as one walks the parking area. This can be frustrating, particularly if one is carrying packages or groceries, or if the weather is inclement.

There have been various attempts over the years to provide vehicle locators that aid in locating and identifying one's vehicle. One of the simplest vehicle locators is a tennis ball, ping pong ball, or similar sized ball mounted atop a car radio antenna. This is a purely visual indicator that has limited usefulness. Other similar vehicle locators such as flags, lights, and the like have also been available, and have limited usefulness and success.

With the advent of car remote controls that lock and unlock doors and also sound the horn, locating one's vehicle by remotely sounding the vehicle's horn has been a relatively common occurrence. Unfortunately, most if not all car remote controls have extremely limited range. In addition, activating a car horn remotely, particularly when using the horn as a locator which may require repeated horn activation, can be annoying to those around the parked car. The sound levels of a vehicular horn are such as to be not only annoying, but also can present a legitimate hazard to a person in close proximity to the activated horn. A remotely activated horn can startle and distract that person and place them in a potentially harmful situation.

It is therefore an object of the present invention to provide a car locator that plays music at a vehicle to be located. It is another object of the present invention to provide a car locator that offers a selection of music to be used for vehicle location purposes. It is another object of the present invention to provide a car locator that controls the volume of music to be played at a vehicle to be located.

These and other objects of the present invention are not to be considered comprehensive or exhaustive, but rather, exemplary of objects that may be ascertained after reading this specification with the accompanying drawings and claims.

BRIEF SUMMARY OF THE INVENTION

In accordance with the present invention, there is provided a musical key fob vehicle locator system for finding a vehicle in a parking area, the locator system comprising a portable radiofrequency controller for producing a radiofrequency output, a radiofrequency receiver operable on the radiofrequency output of said portable radiofrequency controller and installed in a vehicle, a digital audio file system wirelessly controlled by said portable radiofrequency controller through control signals output from said radiofrequency receiver and installed in a vehicle, a digital audio file source that provides digital audio files to the digital audio file system, an amplifier electrically coupled to an output of said digital audio file system and installed in a vehicle, and a speaker electrically coupled to an output of said amplifier and installed in a vehicle.

The foregoing paragraph has been provided by way of introduction, and is not intended to limit the scope of the following claims.

BRIEF DESCRIPTION OF THE DRAWINGS

The invention will be described by reference to the following drawings, in which like numerals refer to like elements, and in which.

Figure 1:
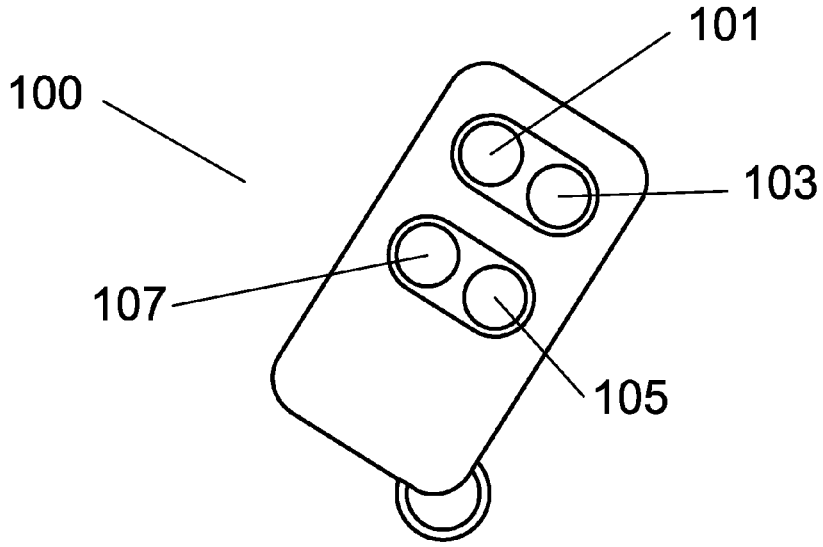
FIG. 1 depicts a musical key fob vehicle locator.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by this specification, drawings, and the appended claims.

DESCRIPTION OF THE PREFERRED EMBODIMENTS

For a general understanding of the present invention and the various embodiments described or envisioned herein, reference is made to the drawings. In the drawings, like reference numerals have been used throughout to designate identical elements.

The present invention and the various embodiments described and envisioned herein provide for a novel and heretofore unrealized system and method for locating a vehicle in a parking area by activating and deactivating a digital audio file system through wireless means to provide a recognizable musical song, riff, clip, segment, or a similar portion or complete composure of music. The music provided is not synthetically generated or otherwise artificial (such as a series of electronically generated tones or jingles common in today's electronic devices), but rather, is a piece of music composed and performed by musicians using actual musical instruments to facilitate the recording. This approach provides a pleasant, personalized, and uniquely recognizable audio locator that is less offensive than a series of electronic tones, a car horn, a buzzer, a siren, or the like. In addition, a personalized selection of music provides a customizable vehicle locator system that reflects the taste, personality, and likes of the vehicle owner.

Turning first to FIG. 1, a musical key fob vehicle locator 100 is depicted. The shape and physical attributes of the musical key fob vehicle locator 100 may change, or the musical key fob vehicle locator may be integral to another device such as a remote car starter, a car unlocking fob, a wireless communications device, a computer such as a tablet computer, a garage door opener, any of various remote control devices, a vehicle ignition key, and the like. In FIG. 1, several control buttons are depicted. The functions and structure of these control-buttons are exemplary only. Button 107 and button 105 may, in one embodiment of the present invention, be volume control buttons where button 107 reduces volume of the vehicle locator music and button 105 increases volume of the vehicle locator music. Button 101 may activate and deactivate the vehicle locator music, and button 103 may perform a peripheral function such as turning on the vehicle headlights, reverse lights, or similar indicators that may assist in vehicle location.

Figure 2:
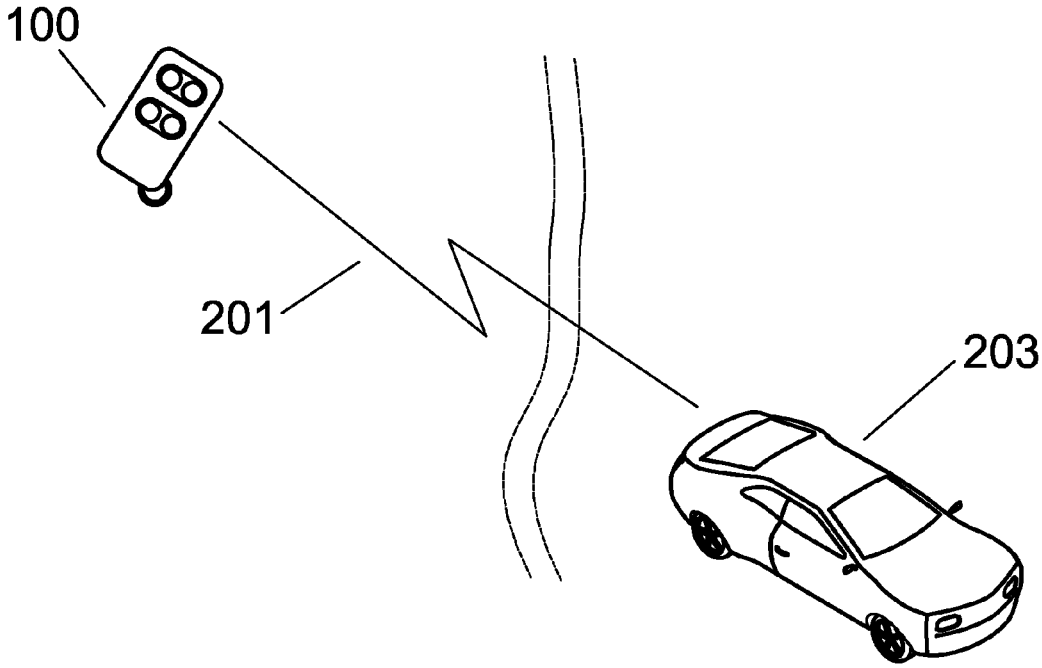
FIG. 2 depicts a musical key fob vehicle locator system.

FIG. 2 depicts a musical key fob vehicle locator system where the musical key fob vehicle locator 100 is shown with a radiofrequency link to receiving electronics contained in a vehicle 203. The receiving electronics comprise a radiofrequency receiver operable on the radiofrequency output of the portable radiofrequency controller contained within the musical key fob vehicle locator 100. The radiofrequency receiver and related connections to digital audio files and systems will be further described by way of later figures. In one embodiment of the present invention, the portable radiofrequency controller operates on frequencies allocated by regulatory agencies such as the Federal Communications Commission (FCC) in the United States. An example of such allocated frequencies is the 315 Megahertz frequency hand allocated to remote keyless entry systems in the United States and Japan, and the 433.92 Megahertz band in Europe. In addition, the output of the portable radiofrequency controller may be encrypted to prevent unauthorized reception and deception of control signals contained in the radiofrequency transmission from the key fob car locator 100. Other embodiments of the present invention may use different frequencies and protocols. For example, the Bluetooth short range wireless connectivity standard (IEEE standard 802.15) using frequency-hopping spread spectrum techniques in the 2,400 to 2,483.5 Megahertz hands. In other embodiments of the present invention, the key fob car locator operates using a cellular network or a combination of a cellular network and other radio frequencies and protocols. FIG. 2 depicts a wireless link with two parallel lines indicating that the link may not be a direct link, but may also traverse other routes, networks, frequencies, protocols, and the like.

Figure 3:
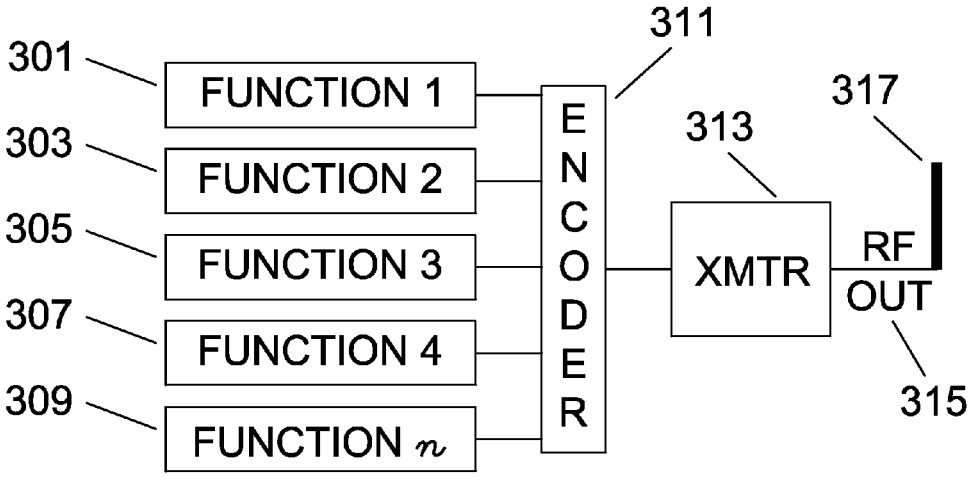
FIG. 3 is a functional block diagram of the musical key fob vehicle locator transmit circuitry.

FIG. 3 is a functional block diagram of the musical key fob vehicle locator transmit circuitry. A portable radiofrequency controller is contained within the musical key fob locator that contains the transmit circuitry depicted in the block diagram of FIG. 3. A transmitter 313 produces an appropriate radiofrequency output 315 that is radiated by way of an antenna 317. The radiofrequency transmitter may utilize a variety of frequencies, for example, the 315 Megahertz frequency band allocated to remote keyless entry systems in the United States and Japan. and the 433.92 Megahertz band in Europe. Encryption of the control signals may also be employed. Other frequencies and protocols may include the Bluetooth short range wireless connectivity standard (IEEE standard 802.15) using frequency-hopping spread spectrum techniques in the 2,400 to 2,483.5 Megahertz bands. The transmit circuitry receives input from an encoder 311 that converts the various functions requested by a user into a control signal that may be embedded in or otherwise contained in the radiofrequency transmission of the transmitter 313. A plurality of functions are depicted in FIG. 3 by way of 301, 303, 305, 307, and 309. More or fewer functions may be present. The functions include, for example, volume control, activate the vehicle locator music, deactivate the vehicle locator music, change song, load song, delete song, peripheral function such as turning on the vehicle headlights, reverse lights, or similar indicators that may assist in vehicle location, lock and unlock the vehicle, open vehicle trunk or hatch, stall the vehicle, disable the vehicle, activate an alarm or a panic function, and the like. Each of these functions is enabled by way of a user interface such as a button, a knob, a touch screen, or like. Once a function is activated by way of a signal such as, for example, a binary "1" or a closed circuit condition, the indicator is sent to the encoder 311 where the change in state of the function (function request) is encoded to a control signal or signals that may be transmitted by way of radio frequency using the transmitter 313.

Figure 4:
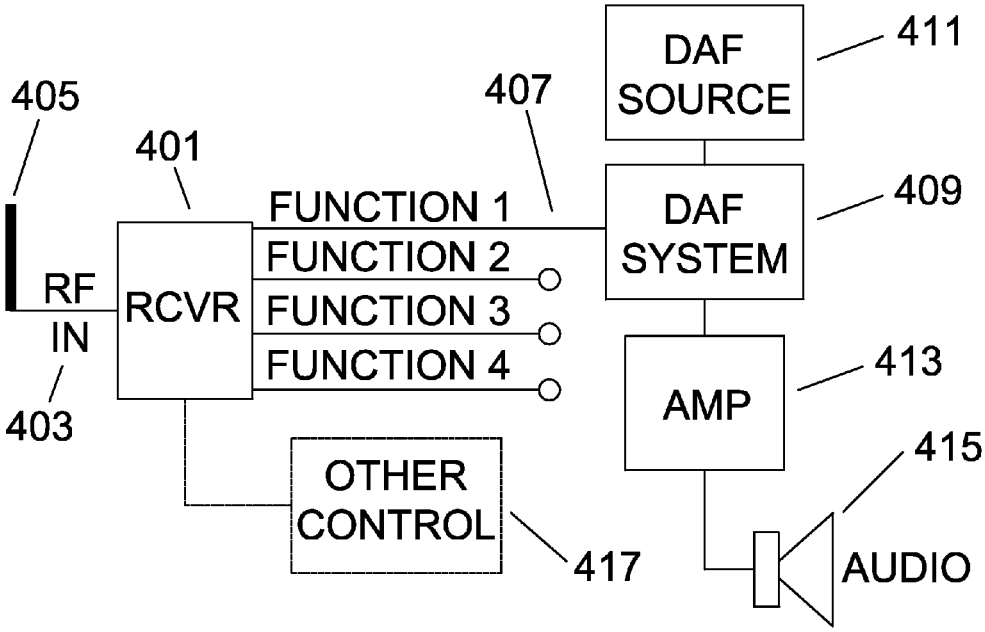
FIG. 4 is a functional block diagram of the musical key fob vehicle locator receive circuitry.

FIG. 4 is a functional block diagram of the musical key fob vehicle locator receive circuitry. A radiofrequency receiver 401 is coupled to an appropriate wavelength antenna 405 to provide radiofrequency input 403 to the radiofrequency receiver 401. The radiofrequency input matches the radiofrequency output 315 depicted in FIG. 3 such that communication between the transmit circuitry depicted in FIG. 3 and the receive circuitry depicted in FIG. 4 can occur. Various functions 407 are received by the radiofrequency receiver 401 using control signals that have been transmitted by the transmitter 313 depicted in FIG. 3. FIG. 4 also depicts other controls 417 that may use the same receiver transmitter system of the present invention. Other controls may include, for example, a connection to vehicle is diagnostics, a connection to a wireless network, an interface to an on board vehicular navigation system, and the like. The primary functions that are sent by the transmitter and received by the receiver 401 are control functions to a digital audio file system 409. Such a digital audio file system 409 converts a digital audio file to an analog output song. Such digital audio file systems are known to those skilled in the art, and are contained in many of the digital audio devices of today, such as MP3 players, CD players, and the like. Digital audio files typically contain sound reproduction using pulse code modulation. A codec is contained in the digital audio file system to perform the coding and decoding of the audio data. Various digital audio file sources 411 may be provided to the digital audio file system to generate audible reproductions of songs and music. Digital audio file formats include WAV, MPEG-4, MP3, and others. Once converted to an analog audio output, the digital audio file system 409 is electrically connected to an amplifier 413 and lastly to a speaker 415 for outputting audible music at the vehicle when the proper control functions are activated.

Figure 5:
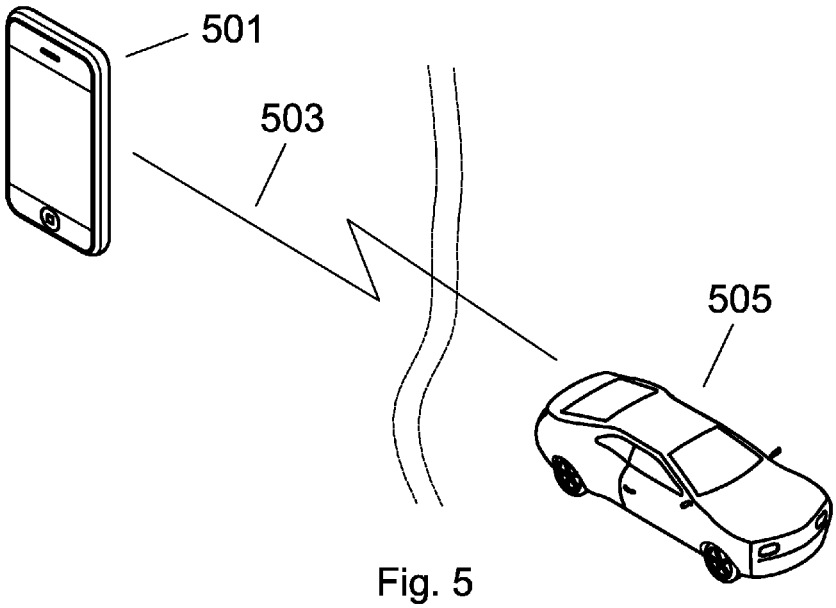
FIG. 5 depicts a wireless communications device activating vehicle locator circuitry.

FIG. 5 depicts a wireless communications device activating vehicle locator circuitry. A wireless communications device 501 may include, for example, a cell phone, a smart phone, a tablet PC, or the like. Many of these wireless communications devices operate using a cellular network. 503 is a wireless connection to the in vehicle receiving and audio electronics, as previously described by way of FIG. 4. As depicted in FIG. 5, the wireless connection 503 may traverse a network as well as other frequencies and protocols. The double vertical dotted line in FIG. 5 indicates that such indirect or networked connections may be present. The in vehicle electronics 505 may include, for example, a cellular transceiver to facilitate connectivity to the wireless communications device 501. An example of such a transceiver is the subscription based communications service offered by OnStar® Corporation, a subsidiary of General Motors. The OnStar® service relies on a CDMA cellular telephone network.

Figure 6:
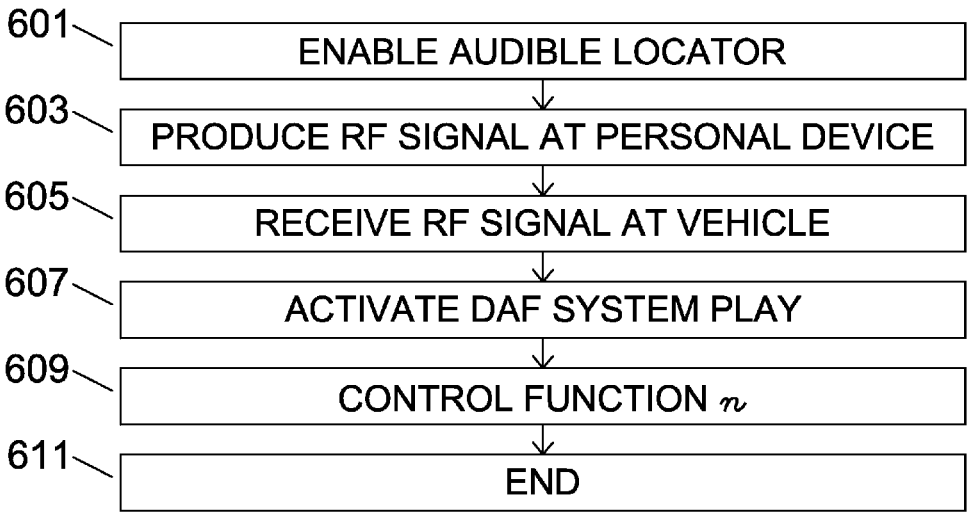
FIG. 6 is a flowchart illustrating a method of the musical key fob vehicle locator.

FIG. 6 is a flowchart illustrating a method of the musical key fob vehicle locator. In use, the musical key fob vehicle locator (audible locator) is enabled in step 601. A personal device such as a key fob produces a radiofrequency signal in step 603. The produced radiofrequency signal is received at a vehicle in step 605, and the digital audio file system play function is activated in step 607. A control function "n" may be activated at any time in step 609. Control function "n" may be an activate or deactivate audio function, a volume control function, a change song function, a load song function, a delete song function, a peripheral function such as turning on the vehicle headlights, reverse lights, or similar indicators that may assist in vehicle location, a lock and unlock vehicle function, an open trunk or hatch function, a start vehicle function, a disable vehicle function, an activate alarm or panic function, and the like. The exemplary method of using the present invention will end in step 611 at an arbitrary time that is elected by the user, such as when the vehicle is located and moving, parked in a home location, or the like.

Figure 7:
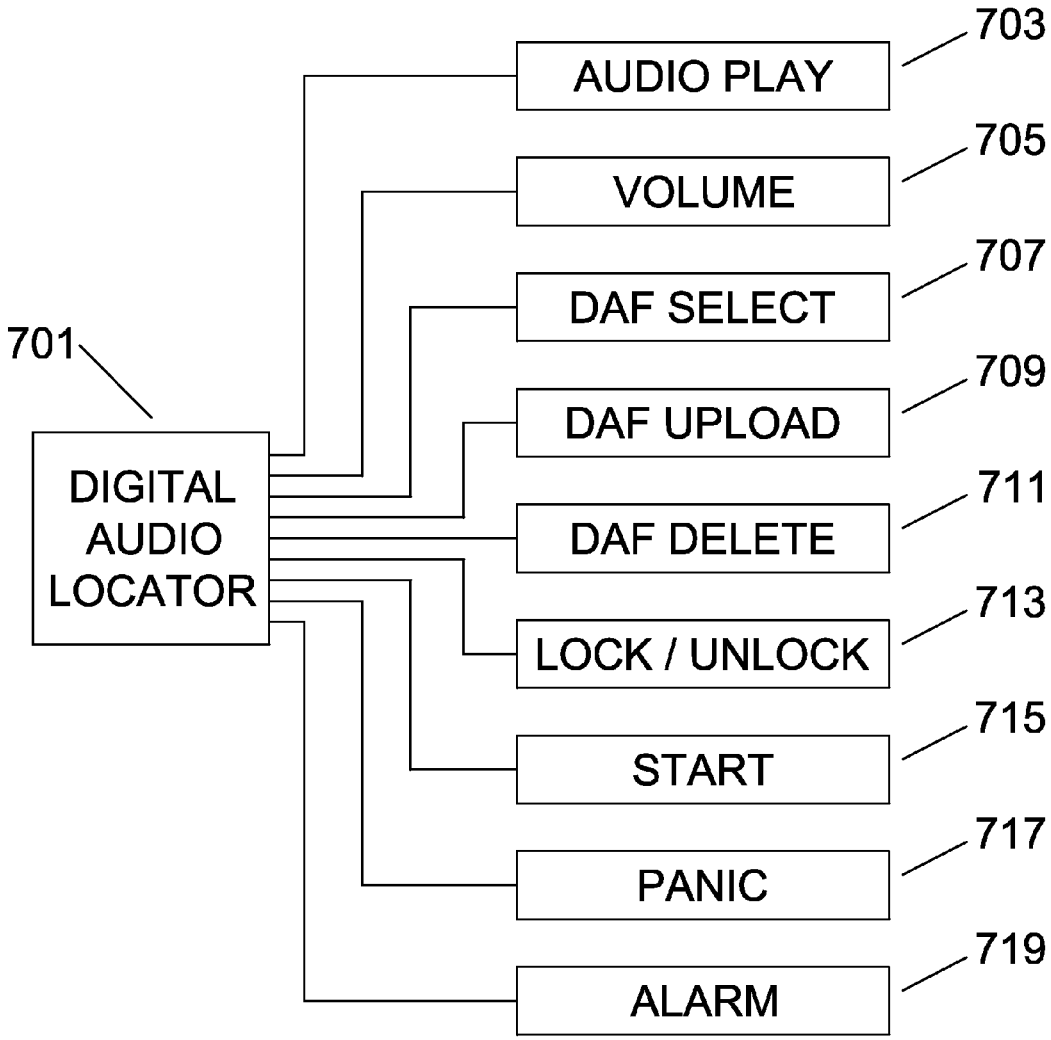
FIG. 7 is a block diagram depicting various functions of the musical key fob vehicle locator.

FIG. 7 is a block diagram depicting various functions of the musical key fob vehicle locator. The digital audio locator function 701 of the musical key fob vehicle locator may contain various functions that are either directly related to music based car location or may be peripheral functions that nevertheless may be present in the musical key fob vehicle locator. Examples of functionality include audio play 703, volume control 705, digital audio file select 707, digital audio file upload 709, digital audio file delete 711, lock/unlock the vehicle 713, start the vehicle 715, panic 717, or activate an alarm 719. These functions are, however, exemplary, and not exhaustive.

It is, therefore, apparent that there has been provided, in accordance with the various objects of the present invention, a musical key fob vehicle locator. While the various objects of this invention have been described in conjunction with preferred embodiments thereof, it is evident that many alternatives, modifications, and variations will be apparent to those skilled in the art. Accordingly. it is intended to embrace all such alternatives, modifications and variations that fall within the spirit and broad scope of this specification, drawings, and the claims appended herein.

What is claimed is:

1. A musical key fob vehicle locator system for finding a vehicle in a parking area, the locator system comprising:

a portable radiofrequency controller for producing a cellular network frequency output;

a radiofrequency receiver operable on the cellular network frequency output of said portable radiofrequency controller and installed in a vehicle;

a digital audio file system wirelessly controlled by said portable radiofrequency controller through control signals output from said radiofrequency receiver and installed in a vehicle;

a digital audio file source that provides digital audio files to the digital audio file system;

an amplifier electrically coupled to an output of said digital audio file system and installed in a vehicle; and a speaker electrically coupled to an output of said amplifier and installed in a vehicle.

2. The musical key fob locator system of claim 1 wherein said digital audio file source is a non-volatile memory device.

3. The musical key fob locator system of claim 1 wherein said digital audio file source is a magnetic storage device.

4. The musical key fob locator system of claim 1 wherein said digital audio file source is an optical storage device.

5. The musical key fob locator system of claim 1 further comprising a door lock and unlock function.

6. The musical key fob locator system of claim 1 further comprising a trunk lock and unlock function.

7. The musical key fob locator system of claim 1 further comprising a panic button function.

8. The musical key fob locator system of claim 1 further comprising a volume control function.

9. The musical key fob locator system of claim 1 further comprising a vehicle start function.

10. The musical key fob locator system of claim 1 further comprising a digital audio file control function.

11. The musical key fob locator system of claim 1 wherein said portable radiofrequency controller is a wireless communications device.

12. A method for locating a vehicle in a parking area comprising the steps of:

enabling a portable radiofrequency controller;

producing a cellular network signal at the portable radiofrequency controller;

receiving the produced cellular network signal at a radiofrequency receiver installed in a vehicle;

activating a digital audio file system play function by producing a control signal at the radiofrequency receiver installed in a vehicle upon receipt of the produced cellular network signal; and disabling the digital audio file system.

13. The method of claim 12 wherein said portable radiofrequency controller is a wireless communications device.

14. A musical key fob vehicle locator system for finding a vehicle in a parking area, the locator system comprising:

a wireless communications device for producing information content comprising control signals contained within a radiofrequency output;

a cellular communications network for receiving said radiofrequency output and relaying the information content of said radiofrequency output;

a radiofrequency receiver for receiving said information content;

a digital audio file system wirelessly controlled by said wireless communications device through control signals output from said wireless communications device;

a digital audio file source that provides digital audio files to the digital audio file system;

an amplifier electrically coupled to an output of said digital audio file system; and a speaker electrically coupled to an output of said amplifier.

15. The musical key fob locator system of claim 14 further comprising a volume control function.

16. The musical key fob locator system of claim 14 further comprising a digital audio file control function.

17. The musical key fob locator system of claim 14 further comprising a digital audio file transfer function.

18. The musical key fob locator system of claim 14 further comprising a digital audio file purchase function.

* * * * *